US006049943A

United States Patent [19]

Carter

[11] Patent Number: 6,049,943

[45] Date of Patent: Apr. 18, 2000

[54] MACHINE FOR REMOVING WATER FROM OUTDOOR SURFACES

[76] Inventor: George A. Carter, 2615 Woods La., Garland, Tex. 75044

[21] Appl. No.: 09/182,171

[22] Filed: Oct. 29, 1998

[51] Int. Cl.[7] ..... A47L 5/22; A47L 9/02

[52] U.S. Cl. ..... 15/340.3; 15/98; 15/353

[58] Field of Search ..... 15/98, 320, 340.1, 15/340.3, 353

[56] References Cited

U.S. PATENT DOCUMENTS

| | | | |
|---|---|---|---|
| 2,706,863 | 4/1955 | Jones | 15/98 |
| 3,675,266 | 7/1972 | Murray et al. | 15/340.1 |
| 3,683,447 | 8/1972 | Stevenson . | |
| 3,736,619 | 6/1973 | Zamboni . | |
| 3,835,500 | 9/1974 | Zamboni . | |
| 3,923,341 | 12/1975 | Miller | 15/320 |
| 3,950,812 | 4/1976 | Mohr . | |
| 3,967,339 | 7/1976 | Newman . | |
| 4,173,054 | 11/1979 | Ando | 15/98 |
| 4,356,584 | 11/1982 | Zamboni . | |
| 4,445,247 | 5/1984 | Johannessen . | |
| 4,542,594 | 9/1985 | McLaughlin . | |
| 4,879,820 | 11/1989 | McLaughlin . | |
| 4,989,293 | 2/1991 | Bashyam . | |
| 5,115,579 | 5/1992 | Pappas . | |
| 5,244,346 | 9/1993 | Fergusson . | |
| 5,287,581 | 2/1994 | Lo | 15/98 |
| 5,533,577 | 7/1996 | Jucker . | |
| 5,657,503 | 8/1997 | Caruso | 15/98 |
| 5,657,504 | 8/1997 | Khoury | 15/98 |

*Primary Examiner*—Terrence R. Till
*Attorney, Agent, or Firm*—Haynes and Boone, L.L.P.

[57] ABSTRACT

An apparatus comprising a frame, a tank mounted on the frame, swing arms pivotally secured to the frame, drying units secured to a pair of swing arms for removing the liquid from a surface, roller assemblies rotatably secured to a pair of swing arms for forcing the liquid on the surface toward the drying unit. Each of the drying units and the roller assemblies define a collection region for collecting the liquid and the apparatus includes a means for generating air flow that is secured to the frame for removing liquid from the collection region.

21 Claims, 3 Drawing Sheets

MACHINE FOR REMOVING WATER FROM OUTDOOR SURFACES

BACKGROUND OF THE INVENTION

The invention relates generally to a machine for removing water from outdoor surfaces and, more particularly, to a drying unit using a combination of vacuum and water displacement to remove water from an irregular outdoor surface.

Current methods of drying a surface, such as an automobile race track or an artificial turf surface, rely on absorption, evaporation, displacement, jet drying, or wet-vac techniques, but none enjoy the benefits of the present invention. Absorption techniques rely on sponge-like materials that are typically rolled across the surface to be dried, enabling the sponge to absorb the water. The water must then be squeezed out of the sponge-like material, but as conventional squeezing techniques can not remove all of the water from these materials, during its use it loses its efficiency and ability to remove additional amounts.

Evaporation techniques rely upon evaporation of the water into the atmosphere. However, immediately after a rain, which is typically when a surface will need to be dried, the humidity levels approach 100%. High levels of humidity in the atmosphere combined with a lack of sufficient direct sunlight decreases the efficiency of systems that rely upon evaporative techniques. Additionally, these techniques do not work effectively in close proximity to walls at the outer edges of the surface where water tends to puddle. Furthermore, evaporative techniques do not work effectively on surfaces that have irregularities where water can collect because evaporation rates are effected not only by humidity levels, but also by the exposed surface area to the air. Puddles of water trapped in irregularities or along outer edges of a track have reduced surfaces areas and, thus, take longer to evaporate. Whereas deep puddles may be dried using other techniques, such as suction or wet-vac devices, these techniques are not useful for large surface areas.

Therefore, what is needed is a drying unit that can effectively dry a wet surface regardless of the irregularities on the surface or the level of humidity in the air.

SUMMARY OF THE INVENTION

The present invention, accordingly, provides an apparatus that can effectively dry a wet, outdoor surface regardless of the shape of the surface, the irregularities on the surface, or the level of humidity in the air. To this end, the apparatus comprises a frame, a tank mounted on the frame for storing the liquid removed from the surface, a plurality of swing arms pivotally secured to the frame, a plurality of drying units secured to the plurality of swing arms for removing the liquid from the surface, a plurality of roller assemblies each being rotatably secured to a pair of swing arms for forcing the liquid on the surface toward the drying unit, wherein each of the plurality of drying units and the plurality of roller assemblies define a collection region for collecting the liquid, and means for generating air flow secured to the frame for removing the liquid from the regions.

An advantage of the present invention is that it allows effective and efficient drying of the surface, even when the air is very humid.

Another advantage of the present invention is that the size of the apparatus along with its weight distribution makes it is easy to operate and move over banked regions of the surface. Additionally, the size of the apparatus allows it to be used on a variety of surfaces and confined spaces.

DESCRIPTION OF THE EMBODIMENTS

Figure 1:
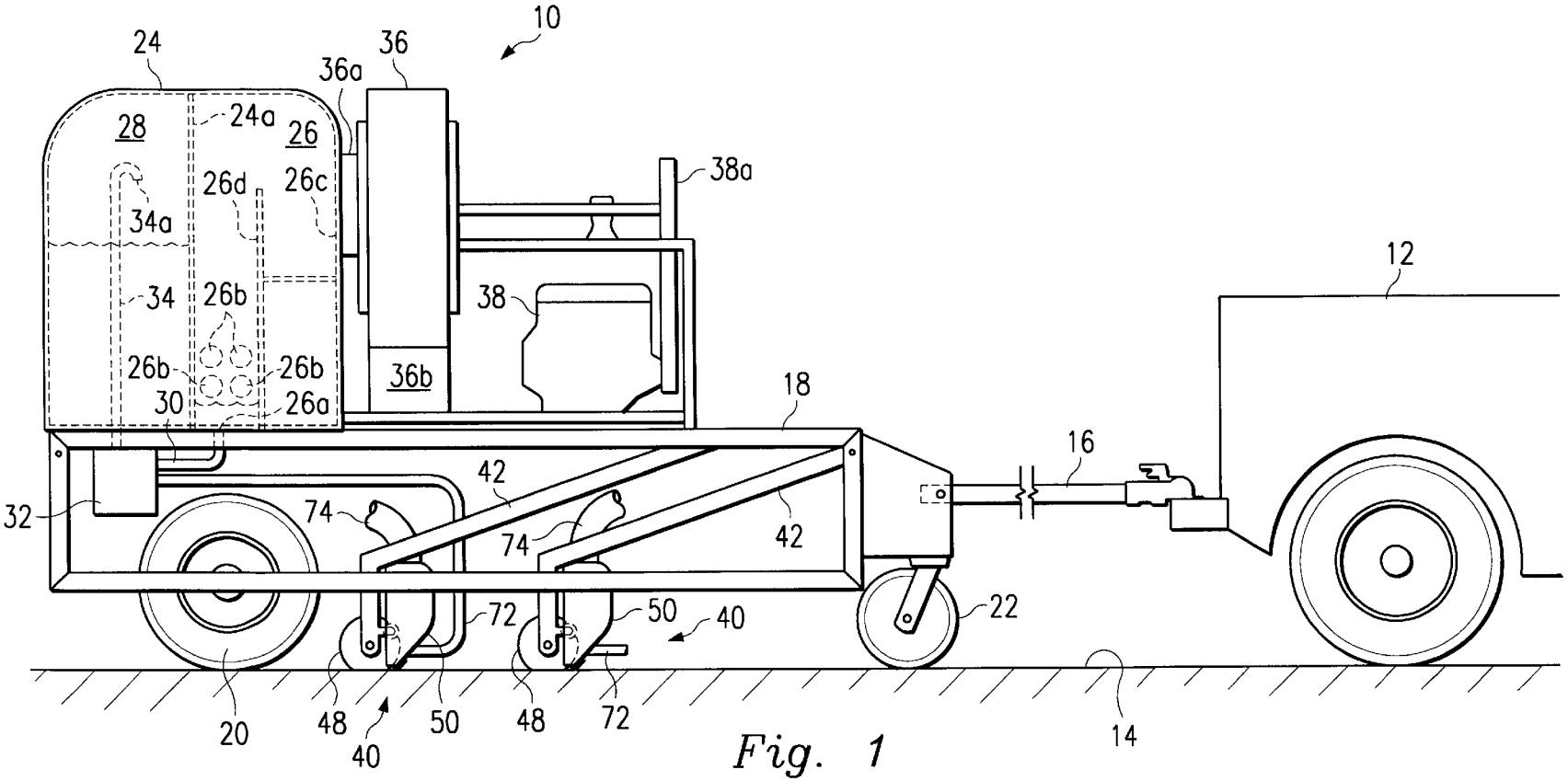
FIG. 1 illustrates a partially cut-away side view of an apparatus according to the present invention being towed by a truck for drying a surface.

Referring now to FIG. 1, a drying machine, generally designated 10, is linked to and towed behind a vehicle 12 for removing water or other fluid from an outdoor surface 14, such as a race track. The drying machine 10 is linked to the vehicle 12 through a tow bar 16. The tow bar 16 is linked to a frame-like chassis 18 of the drying machine 10, made of metal bars or of comparable sturdy material, for supporting all of the components of the drying machine 10. The chassis 18 is maneuvered over the surface 14 using a pair of rear wheels 20 rotatably secured proximate the rear of the chassis 18 and a front caster wheel 22 rotatably secured proximate to the front of the chassis 18. Thus, the operator can steer the drying machine 10 over the surface 14 to be dried by maneuvering the vehicle 12.

Supported on top of the chassis 18 is a tank 24 for receiving and storing the water removed from the surface 14. The tank 24 is generally partitioned by a partition 24*a* into two halves, namely a forward air-flow section 26 and a rearward storage section 28. The air-flow section 26 is in fluid communication with the storage section 28 through piping 30 which leads from the bottom of the air-flow section 26 via a drain 26*a* to a water pump 32 and through piping 34 which leads from the water pump 32 up through the storage section 28, ending in an outflow nozzle 34*a* near the top of the storage section 28. Water received into the air-flow section 26 of the tank 24 can thereby be pumped into the storage section 28 of the tank 24 by the water pump 32 through piping 30 and 34. Water, in the nature of an air-water mixture, is received into the air-flow section 26 of the tank 24 after being removed from the track 14 as described below through a plurality of tank inlets 26*b* in the air-flow section 26.

Supported on the chassis 18 adjacent the tank 24 is a centrifugal suction fan 36 having an inlet 36*a* and an outlet 36*b* to the atmosphere. The suction fan 36 is driven by a similarly supported engine 38 through a gearing drive 38*a*. The inlet 36*a* of the suction fan 36 is coupled to the air-flow section 26 of the tank 24 through an opening 26*c* which is separated from the tank inlets 26*b* by a baffle 26*d*. In general, high velocity air generated by the suction fan 36 is used to remove and carry water from the surface 14 through the tank inlets 26*b* into the air-flow section 26 of the tank 24 in the form of an air-water mixture. As the air-water mixture collects into the air-flow section 26, the mixture separates, with the water passing into the storage section 28 via the drain 26*a*, the water pump 32, and the piping 30 and 34, and the air passing into the suction fan 36 around the baffle 26*d*, through the opening 26*c* and the inlet 36*a*, enabling it to pass into the atmosphere through the outlet 36*b*. In a preferred embodiment of the present invention, the engine 38 is selected to have approximately a forty horsepower (40 HP) output rating for driving the suction fan 36 to displace about five thousand cubic feet per minute (5,000 cfm). However, a variety of engine power and air displacement ratings are contemplated within the scope of this invention.

Water is removed from the track 14 by a plurality of drying units 40, each rigidly mounted onto and secured between a pair of swing arm supports 42 pivotally secured to the chassis 18. In a preferred embodiment and referring to FIG. 2, the drying units 40 are arranged into two parallel rows 44 and 46 extending perpendicular to the direction of travel of the drying machine 10, with the row 46 being disposed behind the row 44. In one embodiment, all of the drying units 40 are of the same size, it being understood that a variety of sizes and a combination of different sized drying units 40 can be utilized and are contemplated within the scope of this invention. Furthermore, it is understood that not only the size of each of the drying units 40, but the number of rows and the number of drying units 40 in each row can be varied within the scope of this invention.

Figure 2:
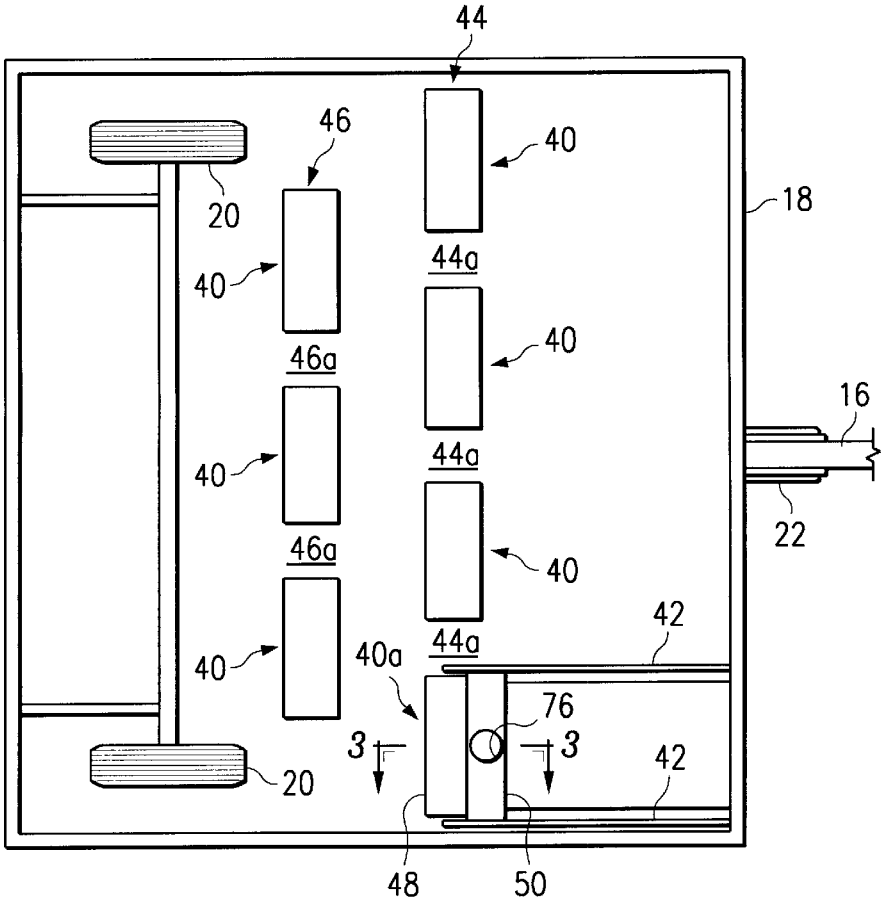
FIG. 2 illustrates a top view of roller assemblies used in the apparatus of FIG. 1.

In the preferred embodiment, there are seven drying units 40, with four in the front row 44 separated by gaps 44*a* and three in the second row 46 separated by gaps 46*a*. As shown in FIG. 2, the drying units 40 in each row are staggered relative to each other so that the gaps 44*a* in the front row 44 are centered directly in front of drying units 40 in the rear row 46 and gaps 46*a* in the rear row 46 are centered directly behind drying units 40 in the front row 44. In this embodiment, the supports 42 securing the drying units 40 disposed in the front row 44 extend diagonally downward and rearward from the top front of the chassis 18, and the supports 42 securing the drying units 40 disposed in the rear row 46 extend diagonally downward and rearward from a center section of the chassis 18, such that the supports 42 allow the drying units 40 to move freely in a vertical plane and substantially eliminate movement in the horizontal plane. Slight rotational movement of the drying units 40 is afforded by the supports 42 to enable the drying units 40 to conform to the surface 14 as described below.

Figure 4:
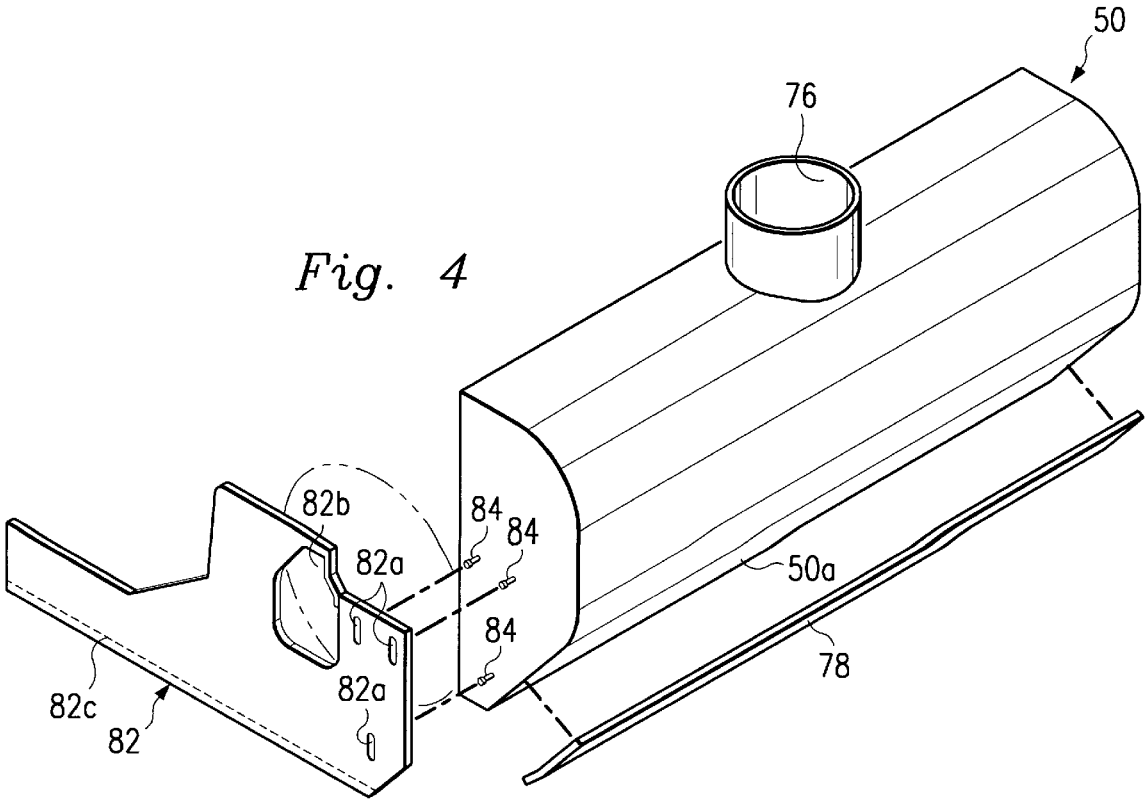
FIG. 4 illustrates an exploded perspective view of the drying unit of FIG. 3.

The details relating to the drying units 40 will be discussed below. For clarity purposes, only one drying unit, drying unit 40*a*, is described in detail and shown in FIGS. 2, 3 and 4, it being understood that each drying unit 40 is similarly constructed.

Figure 3:
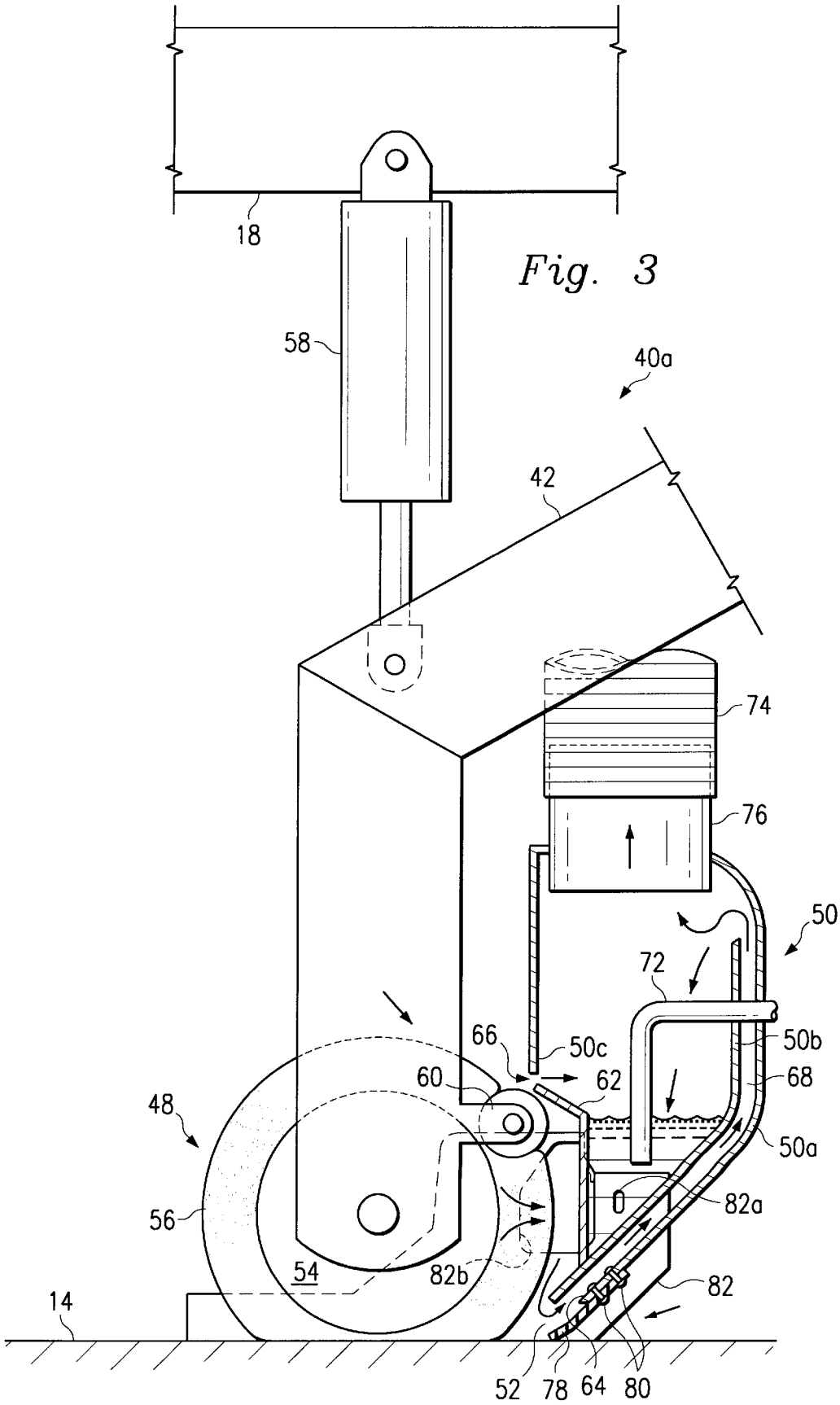
FIG. 3 illustrates a cross-sectional side view of a drying unit mounted in the apparatus of FIG. 1.

Referring to FIG. 3, the drying unit 40*a* is comprised of a roller assembly 48 rotatably mounted between a pair of the swing arm supports 42, and a suction housing 50 integrally secured to the supports 42 which communicates (as described below) with the tank inlets 26*b* of the tank 24 for removing water from the surface 14. The water is removed from a generally enclosed region 52 which is formed between the roller assembly 48 and the housing 50.

Each roller assembly 48 comprises a solid inner roller 54 surrounded by a compressible outer foam tube 56. Downward pressure is maintained on the foam tube 56 by an adjustable conventional air cylinder or spring strut 58 mounted between the chassis 18 and each of the supports 42, thereby allowing vertical movement of the supports 42 while applying downward pressure to compress the foam tube 56 and maintaining a proper pressurized contact with the surface 14. The downward pressure to be applied by the support 42 will vary depending on the foam's density. For example, in one embodiment of the present invention, the pressure is selected to be approximately 1.5 pounds-per-square-inch (psi).

The proper or correct downward pressure must be applied to the foam tube 56 to sufficiently compress the foam tube 56 to behave more like a solid that forces water on the surface 14 into the region 52 without absorbing much of the water. If excessive pressure is applied, then the foam tube 56 tears or wears out prematurely. Alternatively, if insufficient pressure is applied, then the foam tube 56 absorbs too much of the water instead of pushing most of the water in front of the roller assembly 48 into the region 52. The correct amount of pressure is also necessary to enable the foam tube 56 to have spring and absorption capacity to remove water from irregularities in the surface 14 through a combination of pushing the water out of the irregularity into the region 52 and absorbing the water out of the irregularity into the foam tube 56.

As some water from the surface 14 will be absorbed into the foam tube 56, a wringer support bracket 60 rotatably securing a wringer 62 extends integrally from the supports 42 toward the housing 50. The wringer 62 is disposed a predetermined distance from the supports 42 such that the wringer compresses the foam tube 56 to force absorbed water out of the foam tube.

The suction housing 50 has a primary inlet 64 adjacent the region 52 for suctioning water from the surface 14 and a secondary inlet 66 adjacent the wringer 62 for receiving water compressed out of the foam tube 56 by the wringer. The primary inlet 64 comprises a narrow channel 68 opening into the housing 50 and formed between a leading wall 50*a* of the housing 50 and an interior wall 50*b* inwardly spaced from and parallel to the wall 50*a*. The secondary inlet 66 comprises a narrow, horizontal gap formed in a trailing wall 50*c* of the housing 50 adjacent the wringer 62. The water from both the inlets 64 and 66 collects in the bottom of the housing 50 as shown in FIG. 3. Piping 72 is disposed within the bottom of the housing 50 and leads to the water pump 32 for pumping water out of the housing 50 and into the storage section 28 of the tank 24 via the piping 34.

While some of the water compressed out of the foam tube 56 by the wringer 62 will naturally enter the housing 50 through the inlet 66, most is sucked into the housing 50 as described below. Moreover, water in the region 52 must be suctioned into the inlet 64. Suction is provided to the housing 50 via a hose 74 which extends from an outlet 76 in the housing 50 to the tank inlets 26*b* in the air-flow section 26 of the tank 24.

To enhance the suction of water out of the region 52 and into the inlet 64 of the housing 50, air gaps leading into the region 52 must be managed and the water within the region must be retained. The leading edge of the region 52 is generally enclosed by the housing 50, specifically the walls 50*a* and 50*b*, together with a flexible member or squeegee 78 secured to and extending downwardly from the wall 50*a* and disposed to engage the surface 14 along the entire length of the drying unit 40*a*. The squeegee 78 is made of a flexible material to remain in constant engagement with the surface 14 as the drying machine 10 passes over irregularities in the surface. While the squeegee 78 is shown as being secured to the wall 50*a* by bolts 80, other conventional securing or clamping methods could be utilized such as securing straps, clamps, rivets, or screws.

The trailing edge of the region 52 is generally enclosed by the foam tube 56 which is biased against the surface 14 as described above. Enclosing each side of the region 52 is a thin sliding end cap 82, in a preferred embodiment three-quarters of an inch thick, secured to each side of the housing 50, the swing arm supports 42 and/or the bracing plate (not shown) integrally connecting the supports 42 to the housing 50, as is more clearly shown in FIG. 4. The end caps 82 have vertically disposed grooves 82*a* for receiving pins 84 extending outwardly from the housing 50, the supports 42 and/or the bracing plate, whereby the end caps 82 may move vertically relative to the housing and the supports. Accordingly, the end caps 82, through the force of gravity and/or a spring (not shown), can maintain contact with the surface 14 as the supports 42 move away from the surface 14. The end caps 82 also contain openings 82*b* which define air entry zones into the region 50. The openings 82*b* are disposed such that the airflow into the region 50 through the air entry zones passes adjacent the edges of the foam tube 56 and thereby facilitates drying of the foam tube 56. In an alternate preferred embodiment, the openings 82*b* may instead be formed directly in the bracing plate (not shown) integrally connecting the supports 42 to the housing 50, and the end caps 82 shortened so as not to cover such openings.

The end caps 82 are made of an abrasion resistant material, such as nylon, plastic, or Teflon®, with a hardened steel insert 82*c* in their lower edges to reduce wear as the end caps 82 are dragged across the surface 14.

In operation, the drying machine 10 is driven over the surface 14 to be dried, such as by towing the machine by a vehicle 12 and a tow bar 16. As the drying machine 10 is towed forward, the pressurized struts 58 of each drying unit 40 bias the squeegee 78 and the foam tube 56 of each drying unit 40 toward the surface 14. The squeegees 78, being flexible, engage the surface 14 to form a seal in front of each roller assembly 40. Likewise, the foam tubes 56 are compressed to form a seal so that the water or other fluid on the surface 14 is generally pushed forward by the foam tubes 56 rather than being absorbed. Simultaneously, the sliding end caps 82 of each drying unit 40, under their own weight or a spring, slide downwardly to engage the surface 14 to complete the enclosed region 52.

As the drying machine 10 is moved over the surface 14, the water on the surface is captured and collected in the regions 52 by being pushed by the foam tubes 56 and blocked by the squeegees 78 and the end caps 82. High velocity air flow enters the regions 52 from the air entry zones defined by the openings 82*b* in the end caps 82, and travels in the direction of the arrows shown on FIG. 3, for removing the water in the regions 52 and depositing it in tank 24. The air flow is created by the suction fan 36, which pulls air through the tank 24, the tank inlets 26*b*, and the hoses 74 which lead into the suction housings 50. The air flow enters the housings 50 through the narrow channels 68. Due to the narrowness of the channels 68, the velocity of the air flowing through the channels 68 increases to a point needed to result in a low pressure zone to carry the water in the regions 52 into the inlets 64 and into the housings 50. As the water is sucked by the air into the housings 50, some of the water separates from the air-water mixture due to a decrease in the velocity of the air-water mixture and deposits at the bottom of the housings. The remainder of the air-water mixture flows into the hoses 78 via the outlets 76 and flows into the air-flow section 26 of the tank 24 through the inlets 26*b*.

As the air-water mixture enters the air-flow section 26, water is deposited and stored in the tank 24. The process of separating water from the air is enhanced by locating the baffle 26*d* between the tank inlets 26*b* and the opening 26*c* so that the mixture must flow up and over the baffle 26*d* to reach the opening. As the mixture flows over the baffle 26*d*, water is separated from the air using gravitational forces, depositing the water at the bottom of the tank 24 in proximity to the drain 26*a*. Also, separation of water from air is enhanced by changing the velocity of the air-water mixture. Accordingly, as the air-water mixture enters the tank 24, the velocity of the air-water mixture decreases because of the increase in volume flow area. Decrease in the velocity of the air-water mixture separates water from air and causes water to be deposited in the tank 24. As water is deposited in the tank 24, the water pump 32 removes water through the drain 26*a* and passes it via the piping 30 and 34 into the storage section 28.

Some of the air that sucks the water in the regions 52 into the inlets 64 enters the regions 52 over the surface of the foam tubes 56, thereby removing some water from the foam tubes 56 and aiding in drying of the foam tubes 56. As the drying units 40 pass over irregularities in the surface 14, water may therefor be absorbed by the foam tubes 56. The foam tubes 56 carry the absorbed water from a bottom position toward the wringers 62 which compress the foam tubes 52 and forces the water out. Thus, during each revolution of the roller assemblies 48, the foam tubes 56 are substantially water-free as they come into pressurized contact with the surface 14.

The water removed by the wringers 62 is then sucked into the housings 50 though the inlets 66 and collects with the water which separated from the air-water mixture sucked into the housings through the inlets 64. The water which collects in the bottom of the housings 50 is removed by the water pump 32 though the piping 72 to the storage section 28 of the tank 24. A drain plug or faucet (not shown) is located on the storage section 28 of the tank 24 to allow the user to drain the water collected in the tank 24.

By having multiple drying units 40 and securing each independently to the chassis 18 using supports 42, variations in the contour (not shown) of the surface 14 do not affect the ability of the drying machine 10 to remove water from the surface 14. Thus, by having a plurality of drying units 40 in each of the rows 44 and 46, the drying machine 10 is able to more effectively remove water from surfaces as each drying unit 40 can move independently from the others through action of the supports 42. Moreover, by staggering the drying units 40 between the rows 44 and 46, the water passing between the gaps 44*a* of the row 44 can be collected by the drying units in the row 46.

It is understood that several modifications, changes, and substitutions are contemplated in the foregoing disclosure and in some instances some features of the invention may be employed without a corresponding use of other features. For example, the drying machine 10 can be made with only one row of drying units 40. Also, various foam compositions can be utilized for the foam tube 56 depending on the surface and conditions under which the drying machine 10 will be used. Additionally, the chassis 18 could have a drive and steering mechanism in place of the tow bar 16 so that the drying machine 10 is self propelled and an operator controls the speed and direction of the drying machine 10 through the steering mechanism, thereby eliminating the need to use the vehicle 12. Moreover, whereas the drying machine 10 has been described for use in removing water from an outdoor surface, the device could also be used to remove spilled fluids on inside surfaces. Accordingly, it is appropriate that the appended claims be construed broadly and in a manner consistent with the scope of the invention.

What is claimed is:

1. A machine for removing liquid from a surface, comprising:

a frame;

means attached to the frame for pushing the liquid into a sliding region on the surface;

a housing attached to the frame and having an inlet disposed adjacent the region;

means secured to the frame for generating a suction air flow within the housing wherein the liquid is sucked off of the surface from the region into the housing via the inlet; and a flexible member extending between the housing and the surface adjacent the region for generally preventing the liquid from leaving the region except through the housing.

2. A machine for removing liquid from a surface, comprising:

a frame;

a rotatable tube attached to the frame and having an absorbable and compressible exterior engaging the surface for pushing the liquid into a sliding region on the surface;

means for biasing the tube against the surface to compress the tube exterior reducing its absorbability;

a housing attached to the frame and having an inlet disposed adjacent the region;

means secured to the frame for generating a suction air flow within the housing wherein the liquid is sucked off of the surface from the region into the housing via the inlet; and means disposed adjacent the region for generally preventing the liquid from leaving the region except through the housing.

3. A machine for removing liquid from a surface, comprising:

a frame;

a rotatable tube attached to the frame and having an absorbable and compressible exterior engaging the surface for pushing the liquid into a sliding region on the surface;

means engaging the tube exterior for wringing absorbed liquid from the exterior;

a housing attached to the frame and having an inlet disposed adjacent the region;

means secured to the frame for generating a suction air flow within the housing wherein the liquid is sucked off of the surface from the region into the housing via the inlet; and means disposed adjacent the region for generally preventing the liquid from leaving the region except through the housing.

4. The machine of claim 3 wherein the housing has an additional inlet disposed adjacent the wringing means for receiving liquid from the tube exterior.

5. The machine of claim 4 further comprising:

a tank attached to the frame; and piping extending between the tank and the housing for passing liquid received into the housing from the housing to the tank.

6. The machine of claim 5 wherein the generating means comprises:

a fan which receives air from the tank and blows air into the atmosphere; and a tube extending between the tank and the housing for sucking air from the housing into the tank.

7. A machine for removing liquid from a surface, comprising:

a frame;

a plurality of means attached to the frame for pushing the liquid into a plurality of sliding regions on the surface;

a plurality of means attached to the frame, one each disposed adjacent one of the plurality of regions, for removing the liquid from the adjacent region off of the surface, and a plurality of means, one each disposed adjacent one of the plurality of regions, for generally preventing the liquid from leaving the adjacent region except through one of the plurality of removing means.

8. The machine of claim 7 wherein each of the plurality of pushing means comprises a rotatable tube having an absorbable and compressible exterior engaging the surface, such tubes aligned longitudinally in a generally straight row.

9. The machine of claim 8 wherein a gap exists between each of the tubes, the machine further comprising a second generally longitudinal row of pushing means spaced from and laterally offset from the first row.

10. A machine for removing liquid from a surface, comprising:

a frame;

means attached to the frame for pushing the liquid into a sliding region on the surface;

a housing attached to the frame and having an inlet disposed adjacent the region;

means secured to the frame for generating a suction air flow within the housing wherein the liquid is sucked off of the surface from the region into the housing via the inlet; and a pair of members extending between the housing and the pushing means on opposite sides of the region along the surface for generally preventing the liquid from leaving the region except through the housing.

11. The machine of claim 10 further comprising means to enable the members to move vertically with respect to the housing.

12. A machine for removing liquid from a surface, comprising:

a frame;

a plurality of rotatable tubes attached to the frame each having an absorbable and compressible exterior engaging the surface for pushing the liquid into an equal number of associated sliding regions on the surface; and a plurality of means attached to the frame, each disposed adjacent one of the regions for removing the liquid from such region off of the surface.

13. The machine of claim 12 wherein the plurality of tubes are aligned longitudinally in a generally straight row.

14. The machine of claim 13 wherein a gap exists between each of the tubes, the machine further comprising a second generally longitudinal row of tubes spaced from and laterally offset from the first row.

15. A machine for removing liquid from a surface, comprising:

a frame;

at least one roller assembly engaging the surface for pushing the liquid into a corresponding sliding region on the surface;

a corresponding swing arm for each roller assembly pivotally secured to the frame for rotatably securing such roller assembly to the frame;

a housing corresponding to each roller assembly secured to the frame wherein each housing includes an inlet disposed adjacent the region corresponding to each roller assembly;

means for generating a suction air flow within each housing wherein the liquid is sucked from each region into the corresponding housing via its inlet;

a pair of members engaging the surface and extending between each set of corresponding roller assemblies and housings on opposite sides of the corresponding regions generally preventing the liquid from leaving the regions except through the housings; and a tank for storing the liquid sucked into the housings.

16. The machine of claim 15 wherein each roller assembly comprises a tube having an absorbable and compressible exterior engaging the surface.

17. The machine of claim 16 further comprising means for biasing the tubes against the surface to compress the tube exterior reducing its absorbability.

18. The machine of claim 16 further comprising means engaging each tube exterior for wringing absorbed liquid from the exterior.

19. The machine of claim 16 wherein each housing has an additional inlet disposed adjacent each wringing means for receiving liquid from the tube exterior.

20. The machine of claim 15 wherein the tank comprises:

a first portion having a plurality of inlets in communication with the housings and a baffle located higher in the tank than the plurality of inlets for separating air from the liquid.

21. The machine of claim 15 wherein the plurality of roller assemblies are longitudinally arranged in two generally parallel rows, wherein each row is longitudinally offset from the other.

* * * * *